US005841222A

United States Patent [19]

Heuvelmans et al.

[11] Patent Number: 5,841,222

[45] Date of Patent: Nov. 24, 1998

[54] LOW-PRESSURE DISCHARGE LAMP

[75] Inventors: Jean J. Heuvelmans, Eindhoven, Netherlands; Hui-Meng Chow, Briarcliff, N.Y.

[73] Assignee: U.S. Philips Corporation, New York, N.Y.

[21] Appl. No.: 757,531

[22] Filed: Nov. 27, 1996

[30] Foreign Application Priority Data

Dec. 1, 1995 [EP] European Pat. Off. ..... 95203304

[51] Int. Cl.[6] ..... H01J 1/14

[52] U.S. Cl. ..... 313/345; 313/491; 313/574; 313/630; 313/346 R

[58] Field of Search ..... 313/491, 492, 313/493, 346 R, 352, 574, 630, 345

[56] References Cited

U.S. PATENT DOCUMENTS 3,706,895 12/1972 Martyny et al. ..... 313/491 X 4,204,137 5/1980 Roy ..... 313/491

4,891,551 1/1990 Will et al. ..... 313/492

5,233,268 8/1993 Heuvelmans et al. ..... 313/491

*Primary Examiner*—Ashok Patel

*Attorney, Agent, or Firm*—F. Brice Faller

[57] ABSTRACT

A low-pressure discharge lamp of the invention is provided with a gas-tight discharge vessel (10) which contains an ionizable filling. Electrodes are arranged inside At least one of the electrodes has a tungsten coil ($20_A$) which is electrically connected to current supply conductors ($30_A$, $30_A$') which extend to outside the discharge vessel (10). The coil ($20_A$) has a central zone ($21_A$) covered with an electron-emitting material ($22_A$) and, on either side, boundary zones ($23_A$, $23_A$') between the central zone ($21_A$) and respective current supply conductors ($30_A$, $30_A$'). The boundary zones ($23_A$, $23_A$') having a covering ($24_A$, $24_A$') of a protective material, comprising a ceramic material having a specific resistance less than 1000 $\mu\Omega$.cm.

6 Claims, 1 Drawing Sheet

LOW-PRESSURE DISCHARGE LAMP

BACKGROUND OF THE INVENTION

The invention relates to a low-pressure discharge lamp provided with a discharge vessel which is closed in a gastight manner and which contains an ionisable filling comprising an inert gas, electrodes being arranged inside the discharge vessel, between which electrodes a discharge path extends. At least one of the electrodes has a coil of a refractory metal which is electrically connected to current supply conductors which extend to outside the discharge vessel, the coil having a central zone covered with an electron emitting material, and, at either side, a boundary zone between the central zone and a respective current supply conductor, the boundary zones having a covering of a protective material.

Such a discharge lamp is known from U.S. Pat. No. 5,233,268. The known lamp is a low-pressure mercury discharge lamp having a tubular discharge vessel in which an electrode of the kind described above is arranged on either side. The coil of each electrode has a central zone covered with an electron emitting material composed of a mixture of oxides of the alkaline earth metals barium, calcium and strontium. Usually the emitter is applied in such lamps by covering the central zone with a suspension of carbonates of the alkaline earth metals mentioned above. After the electrodes have been mounted in the discharge vessel, but before the discharge vessel has been closed, the electrodes are resistively heated by a current passed through them. This results in a conversion of the carbonates into oxides, carbon dioxide being released during this process. The boundary zones adjoining the current supply conductors are usually left free of emitter, as these zones remain too cool during resistive heating to result in a conversion of the carbonates. Taking into account tolerances during the manufacturing process, the boundary zone of the coil is of the order of one to a few mm. An incomplete conversion of the carbonates would result in a conversion thereof in the finished lamp. The release of carbon dioxide in the discharge vessel would seriously hamper further lamp operation.

Circuits for supplying low-pressure discharge lamps can be subdivided into so-called hot starting and cold starting circuits. With the former type of circuit the electrode of the lamp is preheated before ignition of the lamp. In cold starting circuits the lamp is ignited without preheating. The latter type of circuit can be relatively simple and cheap as no additional means for heating the electrodes are required. However, the life of lamps operating on such a circuit is mainly determined by the switching life, i.e. the number of times they can be switched on.

A filling comprising an inert gas with a low atomic weight, such as neon, and at a relatively low pressure, of the order of a few mbar, is favourable for obtaining a high light output. However, these circumstances negatively influence switching life. Short operation periods also tend to reduce switching life.

In the known lamp the current supply conductors to the coil are covered by an insulating glass sleeve which also covers the boundary zones of the coil. This measure forces the arc to strike at the central zone. The measure significantly increases the switching life of the lamp as it prevents the discharge arc from applying itself to the metal of the boundary zone of the coil and thus damaging the latter during a cold start of the lamp. A drawback of the known lamp is, however, that the sleeves are relatively difficult to mount. In particular, this is a drawback in large-scale manufacture of the lamp.

SUMMARY OF THE INVENTION

It is an object of the invention to provide a low pressure discharge lamp of the kind mentioned above which can be manufactured relatively easily and which still has a relatively long switching life.

According to the invention, the protective material comprises a ceramic material having a specific resistance less than 1000 $\mu\Omega$.cm. Surprisingly, while these materials, in contrast to the materials used in the known lamp, have a relatively good electrical conduction, they do not negatively affect switching life, but instead increase the switching life. It is presumed that the discharge arc strikes at the covering on the boundary zones during cold ignition until the electron emitting material is sufficiently hot to function as such. Unlike insulating ceramics, ceramic materials of the kind mentioned above show a good adhesion to metals. This renders it possible to apply these materials to the coil relatively easily. The ceramic materials may, for example, be applied to the coil as a powder in a suspension with a suspension agent such as butyl acetate and a binder such as nitrocellulose. Alternatively, an aqueous suspension may be used for example. The suspension agent and the binder may subsequently be expelled through heating of the electrode.

A favorable embodiment of the low pressure discharge lamp of the invention is characterised in that specific resistance of the ceramic material is less than 100 $\mu\Omega$.cm. In this embodiment, the covering of protective material comprises preferably at least one compound selected from the group of borides, carbides, silicides, and nitrides of at least one metal selected from the group of titanium, zirconium, hafnium, niobium, tantalum, molybdenum and tungsten. These materials have a specific resistance in the order of a few to a few tens $\mu\Omega$.cm. Furthermore, these materials have melting points of over 2000° C., which is sufficiently high compared with temperatures normally prevailing in electrodes of low-pressure discharge lamps.

Borides of the metals from the above-mentioned group are particularly suitable for this purpose. Ceramic materials of this kind have a very high melting point, above 3000° C., and also a high dissociation energy of the order of 2000 kJ/mole. These properties render them also very suitable for use in lamps having electrodes operating under extreme circumstances.

The coil may have end zones extending beyond the current supply conductors to which it is connected. These zones may additionally be covered with the protective material. The covering of protective material may further overlap, for example, a few turns of the covering of electron emitting material.

Since the current conductors are generally relatively thick with respect to the coil, lamp life is not seriously affected when the discharge arc strikes them. However, it may result in sputtering of the current conductors, which can in its turn cause a discoloring of the discharge vessel and can have a negative effect on the functioning of the emitter. In a favorable embodiment, the low-pressure discharge lamp of the invention is characterised in that the protective material also covers a portion of the current conductors adjoining the coil. In this way discoloring of the discharge vessel and deterioration of the emitter is prevented.

The discharge lamp of the invention may have one electrode which is provided with a covering of protective material as described above. Such a lamp is suitable for operation on a power supply providing at least DC ignition, the electrode provided with the protective coating being the cathode. A favorable embodiment of the low-pressure discharge lamp according to the invention is characterised in that either electrode has a coil provided with a covering as described above. Such a lamp is also suitable for ignition on an AC power supply.

DETAILED DESCRIPTION OF THE PREFERRED EMBODIMENT

Figure 1:
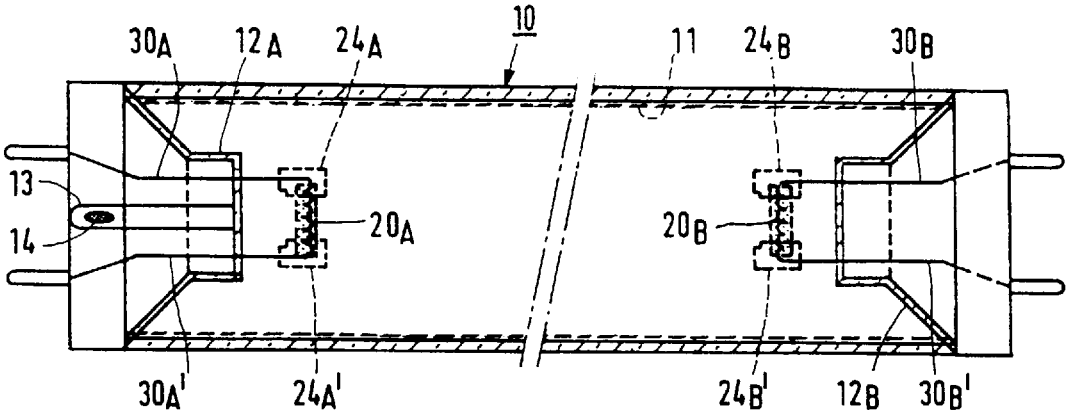
FIG. 1 shows a low-pressure discharge lamp according to the invention in longitudinal section.

The low-pressure discharge lamp shown in FIG. 1 is provided with a discharge vessel 10 which is closed in a gastight manner and contains an ionisable filling, here comprising mercury and an inert gas. For this purpose, an amalgam 14 of 5.5 mg of mercury with 180 mg of an alloy of PbBiSn is arranged in an exhaust tube 13 which is in communication with the discharge vessel. The inert gas is formed by 5 mbar of a mixture of neon and argon in a volume ratio of 75–25%. The discharge vessel 10 is provided with a luminescent layer 11 at an inner surface. Electrodes are arranged inside the discharge vessel 10, between which electrodes a discharge path extends. At least one of the electrodes, here both electrodes, has a coil $\mathbf{20}_A$, $\mathbf{20}_B$ of a refractory metal which is electrically connected and mounted to current supply conductors $\mathbf{30}_A$, $\mathbf{30}_A$'; $\mathbf{30}_B$, $\mathbf{30}_B$' at end portions $\mathbf{12}_A$, $\mathbf{12}_B$ of the discharge vessel 10. In this case the refractory metal is tungsten, but molybdenum or another refractory metal may alternatively be used. The current supply conductors $\mathbf{30}_A$, $\mathbf{30}_A$'; $\mathbf{30}_B$, $\mathbf{30}_B$' extend through the end portions $\mathbf{12}_A$, $\mathbf{12}_B$ to outside the discharge vessel 10. The end portion $\mathbf{12}_A$ with its current supply conductors $\mathbf{30}_A$, $\mathbf{30}_A$' and the electrode with coil $\mathbf{20}_A$ mounted thereto are shown in more detail in FIG. 2. The construction at the other end portion $\mathbf{12}_B$ is identical to that shown in FIG. 2.

The coil $\mathbf{20}_A$ has a central zone $\mathbf{21}_A$ covered with an electron-emitting material $\mathbf{22}_A$ comprising a mixture of barium oxide, calcium oxide and strontium oxide. On either side, the coil $\mathbf{20}_A$ has a boundary zone $\mathbf{23}_A$, $\mathbf{23}_A$' between the central zone $\mathbf{21}_A$ and a respective current supply conductor $\mathbf{30}_A$, $\mathbf{30}_A$'. The boundary zones $\mathbf{23}_A$, $\mathbf{23}_A$' have a protective covering $\mathbf{24}_A$, $\mathbf{24}_A$' comprising a ceramic material having a specific resistance of less than 1000 $\mu\Omega$.cm. Suitable materials include a boride, a carbide, a silicide, or a nitride of at least one metal from the group of titanium, zirconium, hafnium, niobium, tantalum, molybdenum and tungsten. Preferably the ceramic material is a boride of a metal selected from the group.

Figure 2:
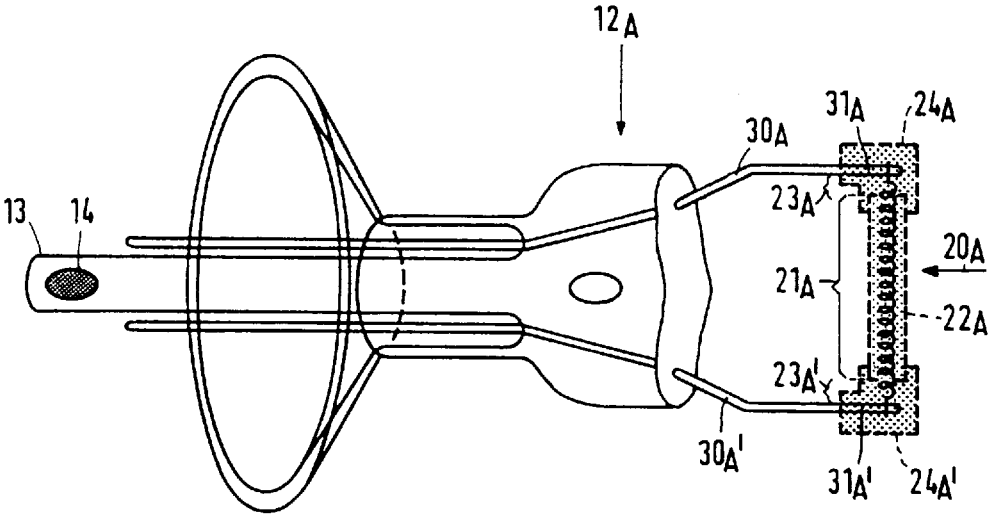
FIG. 2 shows a detail of the lamp of FIG. 1.

In the embodiment of FIGS. 1 and 2, the boundary zones $\mathbf{23}_A$, $\mathbf{23}_A$' of the coil $\mathbf{20}_A$ have a covering $\mathbf{24}_A$, $\mathbf{24}_A$' comprising a layer of particles of zirconium boride having a particle size mainly below 5 $\mu$m. Zirconium boride has a melting point of about 3200° C. and a dissociation energy of 1952 kJ/mole. Its specific resistance is 9.7 $\mu\Omega$.cm. The protective covering $\mathbf{24}_A$, $\mathbf{24}_A$' overlaps about 1 mm of the central zone $\mathbf{21}_A$ covered with the electron-emitting material $\mathbf{22}_A$.

Lamps according to this embodiment were manufactured as follows. A suspension of a mixture of the alkaline earth metal carbonates: barium carbonate, calcium carbonate and strontium carbonate in butyl acetate as a suspension agent and nitrocellulose as a binder was applied to the central zone $\mathbf{21}_A$ of the coil $\mathbf{20}_A$. After this suspension was sufficiently dried, a suspension of zirconium boride particles, also in butylacetate and nitrocellulose in the present case was applied to the boundary zones $\mathbf{23}_A$, $\mathbf{23}_A$'. After the coil $\mathbf{20}_A$ had been mounted in the discharge vessel 10, it was heated resistively so as to convert the carbonates into oxides, while at the same time the binder and the suspension agent were expelled both from the electron-emitting material and from the protective material.

In an endurance test five lamps of the invention as described with reference to FIG. 1 and 2 and five lamps not according to the invention were periodically switched on for one minute and off for three minutes, to measure the switching life of each lamp. The lamps were supplied by a cold starting circuit. In the five lamps not according to the invention the end turns of the coils were not covered, but in other respects these lamps were identical to the lamp of the invention. The lamps not according to the invention had an average switching life of 3000±1000 switching operations. For the lamps according to the invention, a switching life of 7500±1000 switching operations was found. It is apparent that the lamps of the invention, while being relatively easily to manufacture, have a relatively long switching life compared with lamps without a covering of protective material. Accordingly, the measure of the invention allows for a relatively long switching life despite the inert gas consisting mainly of neon, which has a low atomic weight, and the pressure of the inert gas being relatively low.

We claim:

1. A low-pressure discharge lamp provided with a discharge vessel (10) which is closed in a gastight manner and which contains an ionisable filling comprising an inert gas, electrodes being arranged inside the discharge vessel, between which electrodes a discharge path extends, while at least one of the electrodes has a coil ($\mathbf{20}_A$) of a refractory metal which is electrically connected to current supply conductors ($\mathbf{30}_A$, $\mathbf{30}_A$') which extend to outside the discharge vessel, the coil ($\mathbf{20}_A$) having a central zone ($\mathbf{21}_A$) covered with an electron emitting material ($\mathbf{22}_A$), and, on either side, a boundary zone ($\mathbf{23}_A$, $\mathbf{23}_A$') between the central zone ($\mathbf{21}_A$) and a respective current supply conductor ($\mathbf{30}_A$, $\mathbf{30}_A$'), the boundary zones ($\mathbf{23}_A$, $\mathbf{23}_A$') having a covering ($\mathbf{24}_A$, $\mathbf{24}_A$') of a protective material, characterised in that the protective material comprises a ceramic material having a specific resistance less than 1000 $\mu\Omega$.cm.

2. A low-pressure discharge lamp as claimed in claim 1, characterised in that specific resistance of the ceramic material is less than 100 $\mu\Omega$.cm.

3. A low-pressure discharge lamp as claimed in claim 2, characterised in that the covering ($\mathbf{24}_A$, $\mathbf{24}_A$') of protective material comprises at least one compound selected from the group consisting of borides, carbides, silicides, and nitrides of at least one metal selected from the group consisting of titanium, zirconium, hafnium, niobium, tantalum, molybdenum and tungsten.

4. A low-pressure discharge lamp as claimed in claim 3, characterised in that the covering ($\mathbf{24}_A$, $\mathbf{24}_A$') of protective material comprises a boride.

5. A low-pressure discharge lamp as claimed in claim 1 wherein either electrode has said coil ($\mathbf{20}_A$, $\mathbf{20}_B$) provided with said covering ($\mathbf{24}_A$, $\mathbf{24}_A$'; $\mathbf{24}_B$, $\mathbf{24}_B$').

6. A low-pressure discharge lamp as claimed in claim 1, characterised in that the covering ($\mathbf{24}_A$, $\mathbf{24}_A$') of protective material also extends over a portion ($\mathbf{31}_A$, $\mathbf{31}_A$') of the current supply conductors ($\mathbf{30}_A$, $\mathbf{30}_A$') adjoining the coil ($\mathbf{20}_A$, $\mathbf{20}_B$).

* * * * *